US006302948B1

(12) United States Patent
Lin et al.

(10) Patent No.: US 6,302,948 B1
(45) Date of Patent: Oct. 16, 2001

(54) TEXTILE INK-JET PRINTING-PURPOSE DISPERSE DYE MICRO-EMULSION AGENT

(75) Inventors: Cheng Kun Lin; Chong Yu Chen; Wen_Tung Chen; Shiau Yin Peggy Chang, all of Tu-Cheng (TW)

(73) Assignee: China Textile Institute, Taipei Hsien (TW)

( * ) Notice: Subject to any disclaimer, the term of this patent is extended or adjusted under 35 U.S.C. 154(b) by 0 days.

(21) Appl. No.: 09/492,860

(22) Filed: Jan. 27, 2000

(51) Int. Cl.[7] ..... C09D 11/02

(52) U.S. Cl. ..... 106/31.37; 106/31.43; 106/31.58; 106/31.47

(58) Field of Search ..... 106/31.27, 31.33, 106/31.37, 31.43, 31.58, 31.59, 31.47

(56) References Cited

U.S. PATENT DOCUMENTS 5,540,764 * 7/1996 Haruta et al. ..... 106/31.58

5,658,376 * 8/1997 Noguchi et al. ..... 106/31.43

* cited by examiner

*Primary Examiner*—C. Melissa Koslow
*Assistant Examiner*—Veronica F. Faison
(74) *Attorney, Agent, or Firm*—Rosenberg, Klein & Lee

(57) ABSTRACT

The present invention relates to a textile ink-jet printing-purpose disperse dye micro-emulsion agent, which uses dispersing agents such as sodium polynaphthalene formaldehyde sulfonates, surfactants such as POE NP ether, and silicone derivative emulsion-type defoaming agents and bactericidal fungicidal agents for ink-jet CMYK four-color disperse dyes forming a stable dye micro-emulsion through micro-jetting homogenized emulsifier. This invention focuses on the disperse dyes suitable for polymers, applying a low-cost environmentally protective micro-emulsion agent in the ink protection technology so that the O/W model becomes a stable and homogenized system. This gives the textile ink-jet printing-purpose disperse dye micro-emulsion agent, with a dye particle diameter lying below 300 nm and high storage stability, rinse, sublimation, and light fastness over 4.

8 Claims, No Drawings

TEXTILE INK-JET PRINTING-PURPOSE DISPERSE DYE MICRO-EMULSION AGENT

FIELD OF THE INVENTION

The present invention is related to a textile ink-jet printing-purpose disperse dye micro-emulsion agent. It uses dispersing agents such as sodium polynaphthalene formaldehyde sulfonates, surfactants such as POE NP ether, silicone derivative emulsion-type defoaming agents and bactericidal fungicidal agents for ink-jet CMYK four-color disperse dyes and forms a stable dye micro-emulsion through micro-jetting homogenized emulsifier.

DESCRIPTION OF PRIOR ART

Agents of surfactants such as POE ether and other auxiliaries have been reported in the following literature:

a. Anion on-ion surfactants, such as polyoxyethylene ether, were used in U.S. Pat. Nos. 5,658,376, 5,749,952, and 5,226,957 for non-water-soluble pigment micro-emulsion dispersing agents.

b. Japanese patent Nos. 09071742, 09291235, and 09279489 show that disperse dye ink is also added with disperse agents (the use of glycerol and polyoxyethylene alkyl ether by Japanese patent No. 09071742), water-soluble macro-molecules (polyethylene oxide), and viscosity modifiers.

c. U.S. Pat. No. 5,047,084 mentioned the use of stearic acid, esterfied fatty acid, and mineral oil as media, the use of 25% of polyoxyethylene sorbitan monostearate, and bis (2-ethylhexyl) sulfosuccinic acid as surfactants, and the use of triethanolamine as a co-solvent. After these have been mixed and stirred evenly together, a black dye (typophorol) and a blue dye (sudan blue60) is then added and then heated to 85° C. to form a homogeneous micro-emulsion system, which offers a variety of material universality, rapid drying, continuous stable ink-jet effect to the foaming-pressure type inkjetting.

SUMMARY OF THE INVENTION

It is an objective of this invention to provide a textile ink-jet printing-purpose disperse dye micro-emulsion agent.

Disperse dyes should be made even dispersing in water by means of disperse agents or surfactants, but particles of such disperse dyes easily coagulate and precipitate after being left alone for some time. To produce this disperse dye ink for synthetic fibers, disperse dyes should evenly and stably disperse in a water medium and should not develop agglutination, quality changes, and precipitation, resulting in the blocking of the spray hole. In jetting to form ink drops on fibers, bleeding and color differences should not develop. The above-required properties can effectively be achieved by emulsion technology.

Micro-emulsion is defined as a thermodynamically stable and homogenized "solution", which can maintain its stable condition in a frozen and molten medium, formed by water, oil, surfactants, co-surface reactive polymer and co-solvent. Water in the system provides a continuous phase and promotes the formation of micro-emulsion particles. Oil refers to the non-continuous phase in which non-water-soluble substances will be surrounded by micro-emulsion drops. Surfactants are primarily the dual-surface reactive substances that produce micro-emulsion drops. Co-surface reactive agents surround every micro-emulsion drop to stabilize the entire micro-emulsion. Polymers surround the micro-emulsion drops, stabilizing and promoting the viscosity. The addition of a co-solvent can prevent an oil phase (such as dyes/paints) from drying so as to block the spray hole through its high-steam air pressure by the action of stabilizing micro-emulsion.

The formed micro-emulsified dyes will produce a great dripping wet force on the ink-jet minerals due to an exceedingly high concentration of organic solvents and surfactants, resulting in bleeding and poor line sharpness. In prior art, such as U.S. Pat. No. 5,047,084, a pre-heating apparatus was installed in the spray head and ink-jet printer to keep the ink in a homogeneous and rapidly dry liquid state. However, this method is too complicated and expensive. In U.S. Pat. No. 5,342,440, water-soluble dyes were added in the b lack and colored ink to reduce line bleeding. Amine oxide was used as a surfactant, lactic, glycol ether, and long chain alcohol were used as co-surface reactive agents, and co-solvents included glycol, diol, ketone, and glycerol derivatives. The above agent was mixed according to their designated ratios.

DETAILED DESCRIPTION OF PREFERRED EMBODIMENT

The non-plate printing in this invention applies to the disperse-dye micro-emulsion agent, which is an environmental protective and low-cost agent, can increase the ink storage and ink-jet stability, and achieve a good jet -printing effect.

In other words, this invention is relates to a method for producting a textile ink-jet printing-purpose disperse dye micro-emulsion agent, which uses the presscake of disperse dyes for the dispersing agents of sodium polynaphthalene formaldhyde sulfonates to give excellent dispersion, heat-proof ability, and the ability of not forming foams—while producing bright colors. After dispersing for 12 hours and filtering to remove impurities, this micro-emulsion agent is then applied as follows: surfactants such as P.O.E. Ether, high-molecule alcohol polyethylene glycol ether, CMC co-polymers, co-solvent, silicone defoaming agent, and thiazole bactericidal fungicidal agents, and then add de-ion water proportionally to reach the appropriate percentage. After stirring even, rapidly homogenize and emulsify these with a micro-jet homogenizing emulsifier to form a micro-emulsion system (with the diameter of dye particles below 500 nm).

The above-mentioned presscake of dispersing dyes should be 100% pure and can be matched with three primary colors (light-, medium-, dark-, and bright-colored) and black color from a wide range of colors. For example:

C.I. Disperse Blue 60, 73, 79, 87, 268, etc . . .

C.I. Disperse Red 60, 82, 91, 92, etc . . .

C.I. Disperse Yellow 33, 64, 114, 119, 186, 198, 211, 224, etc . . . .

The black color is the mixture of three primary colors. Dyes are waterproof with sublimation and light fastness of at least 3. The above properties can guarantee stability of the agent without blocking the jet hole and color-light stability.

The above-mentioned dispersing agents such as sodium polynaphthalene formaldehyde sulfonates should have their effective contents lying within 80 to 95% and the composition of sulfonates within 1.0 to 9.0%, and a pH value lying between 7 and 9.

The general agent of the above-mentioned surfactants such as polyoxyethylene nonyl phenol ether (POE NP ether) is stated as follows:

$$C_{15}H_{23}—(—CH_2CH_2O—)_A—H$$

A(Number of moles)=7~100

The selected HLB value lies between 12 and 20, pH=6~7, and the clouding point lies between 50 and 100° C., with the power to form O/W micro-emulsion particles with disperse dyes and a diameter between 100 and 300 mm, forming a highly soluble, highly stable, and homogenized system. Owing to its neutrality, it does not damage the ink case and can be compatible with the dispersing agents and other auxiliaries of the agent.

The above-mentioned co-surface reactive agents include nonyl phenol polyethylene glycol ether, high alcohol polyethylene glycol ether, fatty alcohol polyethylene glycol ether, and polyoxyethylene sorbitan fatty acid ether. The HLB value should be selected over 15 with a pH value lying between 5 and 8, and be compatible with the above-mentioned surfactants and dyes, resulting in the promoting of the emulsification of dyes and stabilization of the dispersion.

The above-mentioned co-polymers are highly water-soluble and have low biodegradable etherized carboxymethyl cellulose with the composition between 0.5 and 2.5 wt %, viscosity range between 1 and 6 C.P. for ink, and the power to increase the stability of the micro-emulsion. With the increase in the etherization, its water affinity becomes lower, but the promotion of viscosity becomes more noticeable.

The above-mentioned co-solvent should have the following properties: high blowing point, high surface tension, high dye solubility, water affinity, low viscosity, and low odor; for example, ethylene glycol monoethyl ether, methyl carbitaol, ethyl carbitol, triethylene glycol monobuthyl ether, N-methyl-2-pyrrolidone, 1,3-Dimethyl imidzaolidone, and alkanol amines. Among these, N-methyl-2-pyrrolidone is the most suitable.

Since the above agent will produce too much foam due to an exceeding amount of surfactants, it is necessary to add a defoaming agent. The selection of its categories should not damage its existing good dye micro-emulsion system and can effectively remove and inhibit foam. It should be non-ionized with good stability and a pH value lying between 7 and 8. Types suitable for this invention include silicone emulsion and polyoxypropylene polyoxyethylene ether for the mixed emulsion of high silicone oil, mineral oil, and fatty acid.

When only water remains in all the agent mix, water should be de-ionized, which can speed up the formation of the O/W micro-emulsion system, increase surface tension, is the most environmental-protective and is the best medium. However, this turns out to be a medium for the growth of fungi, therefore, it is necessary to add bactericidal fungicidal agents. Henceforth, a non-toxic medium, which can effectively inhibit and destroy a variety of bacteria and algae without harming the human body, such as benzo amines, methyl amine, and organic nitrogen sulfates, is selected.

Detailed Explanation of the Implementation Examples:

EXAMPLE 1

Grind the four-color CMYK, pure presscake of disperse dye by means of a grinder and disperse to a diameter of approximately 800 nm with dispersing agents such as sodium polynaphthalene formaldhyde sulfonate. After filtering the particle size with a screen, the following micro-emulsion agent, such as defoaming agent, bactericidal fungicidal agents, and de-ionized water is added accordingly. After stirring to evenness, emulsify dye particles at a high speed by means of a micro-jet homogenizing emulsifier to make the diameter of the dye particles even smaller, the particles more homogenized, and more stable (with the average diameter of the particles below 300 nm) to give a entirely successful dye micro-emulsion system suitable for jet-printing with a pH value between 7 and 8, viscosity between 2 and 6 C.P., with continuous ink jetting for over six hours and with rinsing (AATCC61~1986 II Method A) and sublimation (AATCC117-1989 180° C.) fastness over 4.

The agent is as follows:

Dyes: C.I. Disperse Blue 60: 1.5 g.

C.I. Disperse Red 92: 1.5 g.

C.I. Disperse Yellow 114: 2 g

Kayalon Black TA-SF 200: 2.5 g.

Dispersing agents: sodium polynaphthalene

Fonnaldehyde sulfonate: 3 g.

Surfactant: $X—C_{15}H_{23}—(—CH_2CH_2O—)_A—H$: 2.5 g.

Co-surface reactive agent: Nonyl phenol polyethylene glycol ether: 2 g.

Co-solvent: N-methyl-2-pyrrolidone: 8 g.

Polymer: di-ether carboxymethyl cellulose: 1.5 g.

Defoaming agent: silicone: 0.04 g.

Bactericidal fungicidal agent: thiazolore8: 80 ppm

De-ionized water: 80 g.

EXAMPLE 2

The method, steps, and flowchart are the same as those of Example 1.

The agent is as follows:

Dyes: C.I. Disperse Blue 268: 1 g.

C.I. Disperse Red 60: 2 g.

C.I. Disperse Yellow 119: 1.5 g

Wide Tex Disperses black D-BN: 1.5 g.

Surfactants: $X—C_{15}H_{23}—(—CH_2CH_2O—)_A—H$: 2 g.

Co-surface reactive agent: Nonyl phenol polyethylene glycol ether: 2 g.

Co-solvent: N-methyl-2-pyrrolidone: 5 g.

Polymer: di-ether carboxymethyl cellulose: 1 g.

Defoaming agent: silicone: 0.02 g.

Bactericidal fungicidal agent: thiazolore: 80 ppm

De-ionized water: 86 g.

From the above description, it can be readily appreciated that this textile ink-jet printing-purpose disperse dye micro-emulsion agent is unprecedented. This invention focuses on the disperse dyes suitable for polymers. Technologically speaking, this uses a low-cost and environmentally protective micro-emulsion agent with high stability and storage stability, meeting the utilization value of the industry.

While particular embodiment of the present invention has been described, it would be obvious to those skilled in the art, that various other changes and modifications can be made without departing from the spirit and scope of the invention. It is therefore intended to cover in the appended claims all such changes and modifications that are within the scope of the present invention.

What is claimed is:

1. An ink set for ink-jet printing on textiles, wherein each of four-color CMYK disperse dye presscakes is separately ground by a grinder with sodium polynaphthalene formaldehyde sulfonate as a dispersing agent to particles having an average diameter approximating 800 mn, subsequent to screening the particles of each dye for size, each dye is formed into a micro-emulsion ink, each micro-emulsion ink of the ink set comprising:

a. a dye selected from the group consisting of C.I. Disperse Blue 60: 1.5 g., C.I. Disperse Red 92: 1.5 g., C.I. Disperse Yellow 114: 2 g., and Disperse Black, the Disperse Black being composed of:

(i) C.I. Disperse Yellow 163: 1.0 g., having a formula:

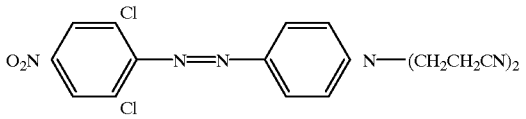

(ii) C.I. Disperse Blue 183: 1.0 g., having a formula:

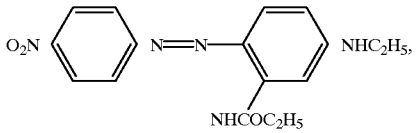

and ii) C.I. Disperse Blue 183: 1.0 g., having a formula:

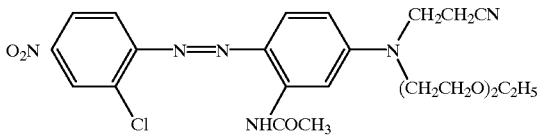

b. a dispersing agent, sodium polynaphthalene formaldehyde sulfonate: 3 g.;

c. a surfactant, polyoxyethylene nonyl phenol ether;

d. a co-surface reactive agent, nonyl phenol polyethylene glycol ether: 2 g.;

e. a polymer, di-ether carboxymethyl cellulose: 1.5 g.;

f. a defoaming agent: 0.04 g.;

g. a bactericidal fungicidal agent: 80 ppm; and, h. deionized water: 80 g.

2. The ink set as recited in claim 1, wherein the dispersing agent has a concentration of 92% w. and a composition of sulfates less than 1.8% w.

3. The ink set as recited in claim 1, wherein the defoaming agent is non-ionized silicone-polyoxyalkylene copolymers.

4. The ink set as recited in claim 1, wherein the bactericidal fungicidal agent is a thiazolore derivative with a pH value=4.

5. An ink set for ink-jet printing on textiles, wherein each of four-color CMYK disperse dye presscakes is separately ground by a grinder with sodium polynaphthalene formaldehyde sulfonate as a dispersing agent to particles having an average diameter approximating 800 nm, subsequent to screening the particles of each dye for size, each dye is formed into a micro-emulsion ink, each a micro-emulsion ink of the ink set comprising:

a. a dye selected from the group consisting of C.I. Disperse Blue 268: 1 g. having the formula:

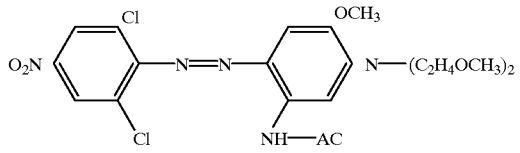

C.I. Disperse Red 60: 2 g., C.I. Disperse Yellow 119: 1.5 g. having the formula:

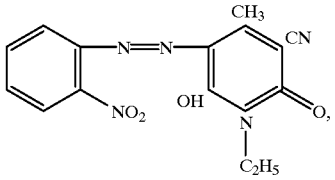

and

Disperse Black, the Disperse Black being composed of (i) C.I. Disperse Orange 61: 1.08 g., (ii) C.I. Disperse Violet 93: 0.44 g., and (iii) C.I. Disperse Blue 291: 0.48 g.;

b. a dispersing agent, sodium polynaphthalene formaldehyde sulfonate: 3 g.;

c. a surfactant, polyoxyethylene nonyl phenol ether: 2 g.;

d. a co-surface reactive agent, nonyl phenol polyethylene glycol ether: 2 g.;

e. a co-solvent, N-methyl-2-pyrrolidone: 5 g.;

f. a polymer, di-ether carboxymethyl cellulose: 1 g.;

g. a defoaming agent: 0.02 g.;

h. a bactericidal fungicidal agent: 80 ppm; and, i. deionized water: 86 g.

6. The ink set as recited in claim 5, wherein the dispersing agent has a concentration of 92% w. and a composition of sulfates less than 1.8% w.

7. The ink set as recited in claim 5, wherein the defoaming agent is non-ionized silicone-polyoxyalkylene copolymers.

8. The ink set as recited in claim 5, wherein the bactericidal fungicidal agent is a thiazolore derivative with a pH value =4.

* * * * *